US009490563B2

(12) United States Patent
Shinmi

(10) Patent No.: US 9,490,563 B2
(45) Date of Patent: Nov. 8, 2016

(54) FEMALE CONNECTOR WITH IMPROVED CONTACT AREA

(71) Applicant: YAZAKI CORPORATION, Minato-ku, Tokyo (JP)

(72) Inventor: Yoshifumi Shinmi, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/854,162

(22) Filed: Sep. 15, 2015

(65) Prior Publication Data

US 2016/0079686 A1 Mar. 17, 2016

(30) Foreign Application Priority Data

Sep. 17, 2014 (JP) ..... 2014-188775

(51) Int. Cl.
*H01R 13/11* (2006.01)
*H01R 13/115* (2006.01)

(52) U.S. Cl.
CPC ..... *H01R 13/115* (2013.01)

(58) Field of Classification Search
CPC ..... H01R 4/48; H01R 13/11; H01R 13/115
USPC ..... 439/842
See application file for complete search history.

(56) References Cited

U.S. PATENT DOCUMENTS 4,874,338 A * 10/1989 Bakermans ..... H01R 13/114 439/842
4,919,628 A 4/1990 Mobley et al.
2012/0295461 A1 11/2012 Hirabayashi

FOREIGN PATENT DOCUMENTS

JP H01-202328 A 8/1989
JP 2001-210417 A 8/2001
JP 2012-256579 A 12/2012
WO 2011/125727 A1 10/2011

OTHER PUBLICATIONS

Japanese Official Action issued on Sep. 6, 2016 in the counterpart Japanese patent application.

* cited by examiner

*Primary Examiner* — Javaid Nasri
(74) *Attorney, Agent, or Firm* — Mots Law, PLLC

(57) ABSTRACT

A terminal includes a terminal connection part into which a tab is inserted, a leaf spring portion arranged in the terminal connection part and deflected by the tab to be inserted, and a tab clamping projection wall extending in a tab insertion direction at a position spaced apart from the leaf spring portion and clamps the tab between itself and the leaf spring portion. The leaf spring portion has a spring side projection protruding toward the tab clamping projection wall. The tab clamping projection wall has a projecting portion with a width smaller than that of the tab clamping projection wall and which protrudes toward the leaf spring portion and extends in the tab insertion direction. The projecting portion is formed in a curved shape that is spaced from the tab at a position of the spring side projection and is close to the tab at front and rear positions.

10 Claims, 5 Drawing Sheets

FEMALE CONNECTOR WITH IMPROVED CONTACT AREA

CROSS REFERENCE TO RELATED APPLICATIONS

This application claims the priority of Japanese Patent Application No. 2014-188775, filed on Sep. 17, 2014, the entire content of which are incorporated herein by reference.

BACKGROUND

1. Technical Field

The present invention relates to a terminal that holds a tab of a mating terminal between a leaf spring portion and a tab clamping projection wall for electrical connection.

2. Related Art

Such a conventional terminal is disclosed in JP 2001-210417 A. As shown in FIGS. 5A and 5B, a female terminal 50 includes a terminal connection part 51 for connecting a male terminal 70 and a wire connection part (not shown) for connecting a wire. The terminal connection part 51 includes a box portion 52 having a terminal insertion chamber 52*a* into which a tab 71 of the male terminal 70 is inserted and a leaf spring portion 53 that extends from a front end of the box portion 52 and is turned back into the terminal insertion chamber 52*a*, and a tab clamping projection wall 54 that is formed by extruding a part of the box portion 52 and is arranged spaced apart from the leaf spring portion 53.

The leaf spring portion 53 is provided with a spring side projection 53*a* protruding toward the tab clamping projection wall 54. The tab clamping projection wall 54 is formed in a curved shape that is spaced from the tab 71 at the position of the spring side projection 53*a* and is close to the tab 71 at the front and rear positions in a tab insertion direction e relative to the spring side projection 53*a*. Such a curved shape provides the tab clamping projection wall 54 with portions that are most prominent at the front and rear positions in the tab insertion direction e relative to the position of the spring side projection 53*a*, that is, a pair of projections 54*a*.

When the tab 71 of the male terminal 70 is inserted into the terminal insertion chamber 52*a* of the female terminal 50, the tab 71 makes contact with the leaf spring portion 53 and the leaf spring portion 53 is deflected by being pressed. This allows the tab 71 to be further inserted into the terminal insertion chamber 52*a*, and the terminals are engaged as shown in FIG. 5A. The tab 71 makes contact at three points including the spring side projection 53*a* of the leaf spring portion 53 and the pair of projections 54*a*, with an elastic restoring force of the leaf spring portion 53 as a contact load.

The female terminal 50, in which the tab 71 of the male terminal 70 makes contact at three points, provides a stable and vibration-resistant contact.

In the conventional example described above, however, the tab 71 is inserted while sliding on the tab clamping projection wall 54 upon insertion of the tab 71 of the male terminal 70, and a sliding width d2 is wide enough and close to a width d of the tab clamping projection wall 54 as shown in FIG. 5C. Therefore it is problematic that a terminal insertion force needs to be large due to a large sliding area of the tab 71.

SUMMARY

Accordingly, an object of the present invention, which has been made to solve the above problem, is to provide a terminal that provides a stable and vibration-resistant contact and needs a small terminal insertion force.

A terminal according to one aspect of the present invention includes a terminal connection part into which a tab of a mating terminal is inserted, a leaf spring portion that is arranged in the terminal connection part and is deflected by being pressed by the tab to be inserted, and a tab clamping projection wall that extends in a tab insertion direction at a position spaced apart from the leaf spring portion and clamps the inserted tab between itself and the leaf spring portion. The leaf spring portion is provided with a spring side projection protruding toward the tab clamping projection wall. The tab clamping projection wall is provided with a projecting portion whose dimension perpendicular to the tab insertion direction is smaller than that of the tab clamping projection wall and which protrudes toward the leaf spring portion and extends in the tab insertion direction. The projecting portion is formed in a curved shape that is spaced from the tab at a position of the spring side projection and is close to the tab at front and rear positions in the tab insertion direction relative to the position of the spring side projection.

The tab clamping projection wall may be formed in a curved shape that is spaced from the tab at a position of the spring side projection and is close to the tab at front and rear positions in the tab insertion direction relative to the position of the spring side projection, and the projecting portion may be formed in a curved shape conforming to the tab clamping projection wall. The projecting portion may be an arc-shaped projection in cross-section perpendicular to the tab insertion direction.

According to an aspect of the present invention, the tab makes contact at three points including the spring side projection of the leaf spring portion and the pair of projections when the terminals are engaged, thereby providing a stable and vibration-resistant contact. Furthermore, the tab is inserted while sliding on the projecting portion protruding further than the tab clamping projection wall upon insertion of the tab of the mating terminal so that a sliding width is smaller than the width of the tab clamping projection wall and a terminal insertion force is reduced. As seen from the above, the terminal provides a stable and vibration-resistant contact, and moreover, the terminal insertion force is small.

DETAILED DESCRIPTION

An embodiment of the present invention will now be described below with reference to the drawings.

Figure 1:
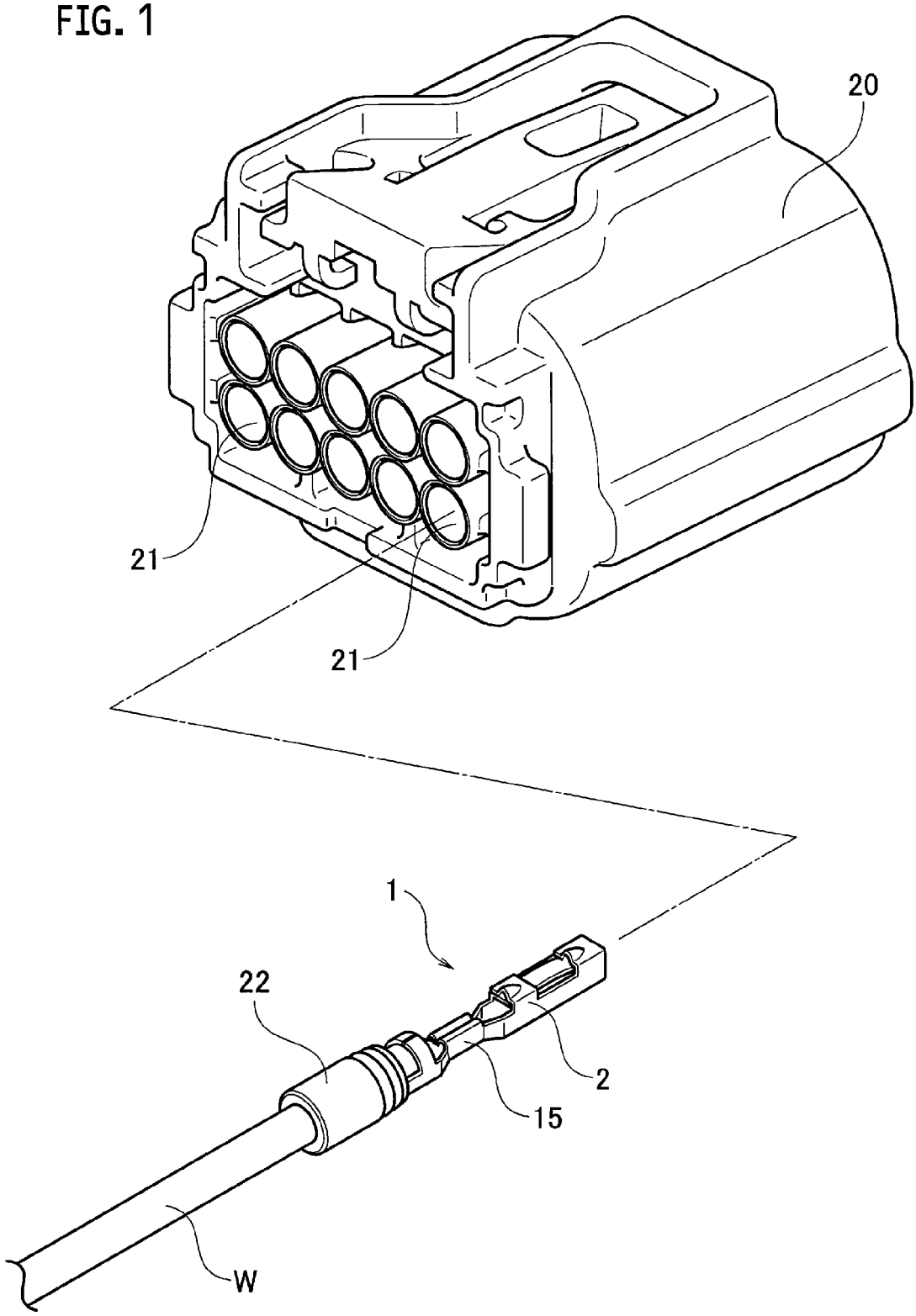
FIG. 1, which illustrates an embodiment of the present invention, is a perspective view showing a female terminal before it is inserted into a connector housing.

FIGS. 1 to 4 illustrate an embodiment of the present invention. As illustrated in FIG. 1, a female terminal 1 as a terminal according to the embodiment is received in a terminal receiving chamber 21 of a connector housing 20. The female terminal 1 is connected to an end of a wire W. The outer periphery of the wire W is provided with a rubber plug 22, which prevents the ingress of water and the like into the connector housing 20. The female terminal 1 is described below.

As shown in FIGS. 2A-2C and 3, the female terminal 1 is formed by folding a conductive plate material having a predetermined shape. The female terminal 1 includes a terminal connection part 2 into which a tab 31 of a male terminal 30 as a mating terminal is inserted and a wire connection 15 to which the wire W is connected (see FIG. 1).

The terminal connection part 2 includes a bottom wall 3, a pair of side walls 4 and 5, and a top wall 6. The bottom wall 3, the pair of side walls 4 and 5, and the top wall 6 constitutes a square tubular shape. The inside of the square tubular shape is provided with a terminal insertion chamber 7 into which the tab 31 of the male terminal 30 is inserted. The terminal insertion chamber 7 receives a leaf spring portion 8 that is turned back at a front end of the bottom wall 3 of the terminal connection part 2. The leaf spring portion 8 is provided with a spring side projection (an indent) 8*a* protruding toward a tab clamping projection wall 10 described below. The spring side projection 8*a* is semi-spherical. The spring side projection 8*a* is formed by embossing the leaf spring portion 8. The bottom wall 3 is provided with an auxiliary spring portion 9. The auxiliary spring portion 9 is formed by raising a part of the bottom wall 3. The tip portion of the auxiliary spring portion 9 is arranged in a deflection region on the distal side of the leaf spring portion 8. That is, deflection of the leaf spring portion 8 causes the auxiliary spring portion 9 to deflect, thereby increasing a spring force.

The top wall 6 is formed of two plates superimposed on each other. The lower plate of the top wall 6 is provided with the tab clamping projection wall 10 protruding into the terminal insertion chamber 7. The tab clamping projection wall 10 is located at a position spaced apart from the leaf spring portion 8. The tab clamping projection wall 10 is formed in a shape that is curved relative to a tab insertion direction e. A curved shape is such that it is spaced from the tab 31 at the position of the spring side projection 8*a* and is close to the tab 31 at the front and rear positions in the tab insertion direction e relative to the position of the spring side projection 8*a*.

Figure 3:
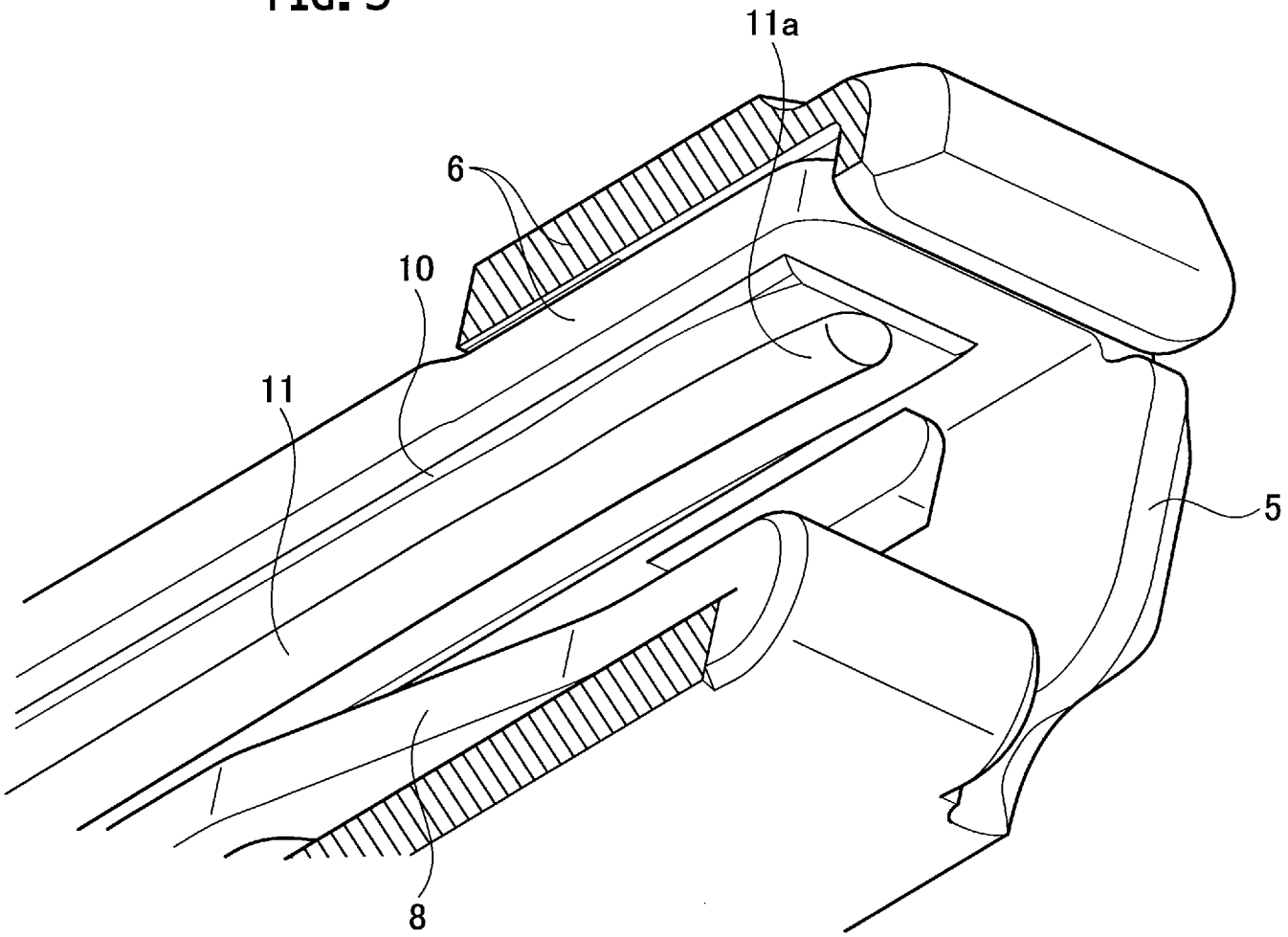
FIG. 3, which illustrates the embodiment of the present invention, is a broken perspective view of a tab clamping projection wall of the female terminal from below.

The tab clamping projection wall 10 is provided, as shown in detail in FIG. 3, with a projecting portion 11 that protrudes toward the leaf spring portion 8 and extends along the tab insertion direction e. The projecting portion 11 is curved relative to the tab insertion direction e, conforming to the curved shape of the tab clamping projection wall 10. The projecting portion 11 has the same amount of projection at any position in the tab insertion direction e. Thus, the curved shape of the projecting portion 11 is provided with points that are most prominent at the front and rear positions in the tab insertion direction e relative to the position of the spring side projection 8*a*, that is, a pair of projections 11*a*. A dimension (width) of the projecting portion 11 perpendicular to the tab insertion direction e is smaller than that of the tab clamping projection wall 10. The projecting portion 11 is an arc-shaped projection in cross-section perpendicular to the tab insertion direction e.

Figure 2A:
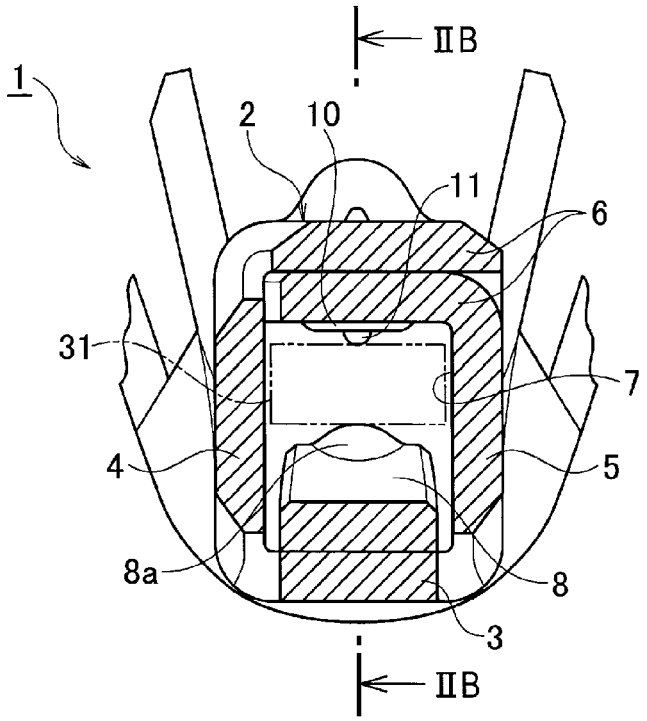
FIG. 2A, which illustrates the embodiment of the present invention, is a cross-sectional view perpendicular to a tab insertion direction of the female terminal.
Figure 2B:
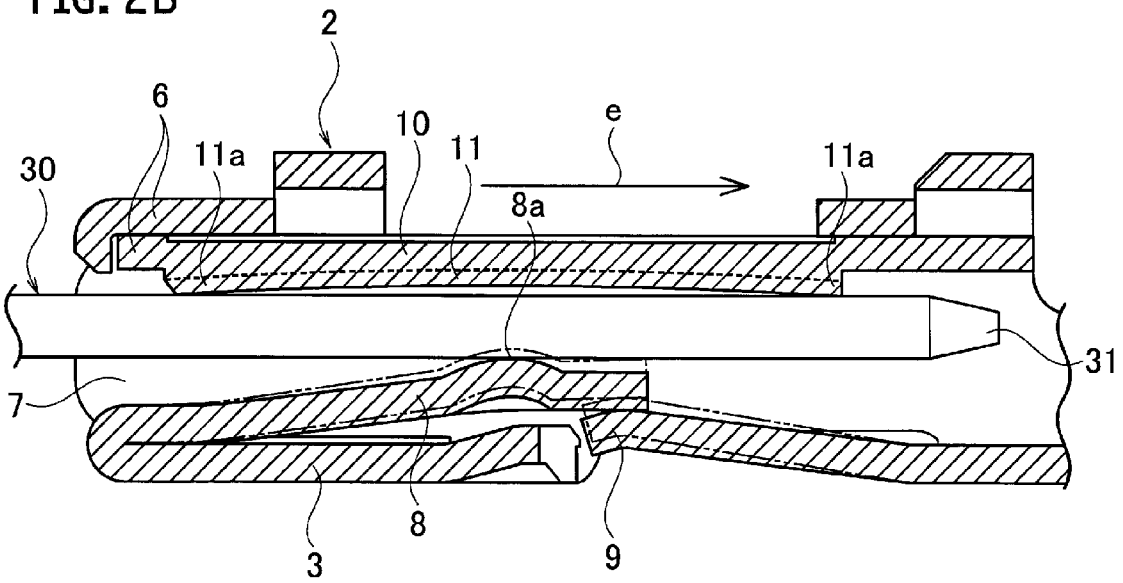
FIG. 2B, which illustrates the embodiment of the present invention, is a cross-sectional view taken along the line IIB-IIB, i.e., a side cross-sectional view, of FIG. 2A.
Figure 4:
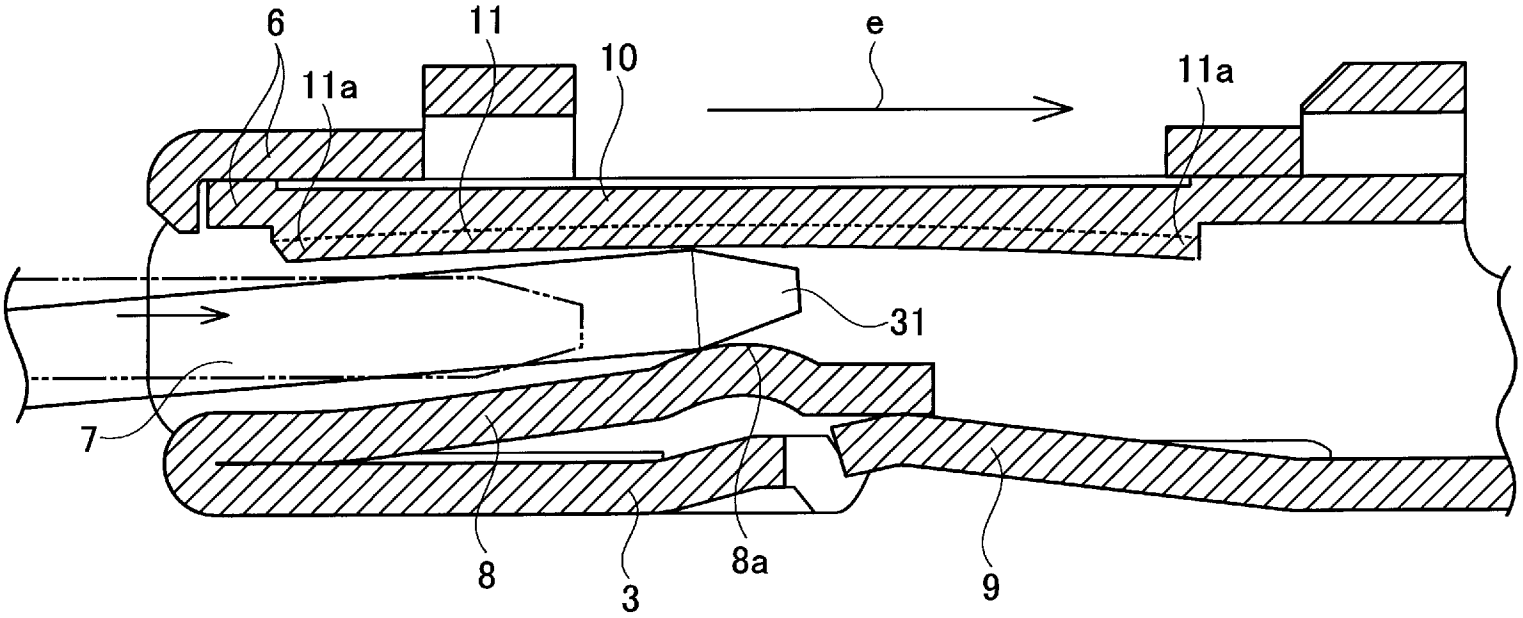
FIG. 4, which illustrates the embodiment of the present invention, is a cross-sectional view of a substantial part of the female terminal when a male terminal is initially inserted.
Figure 5A:
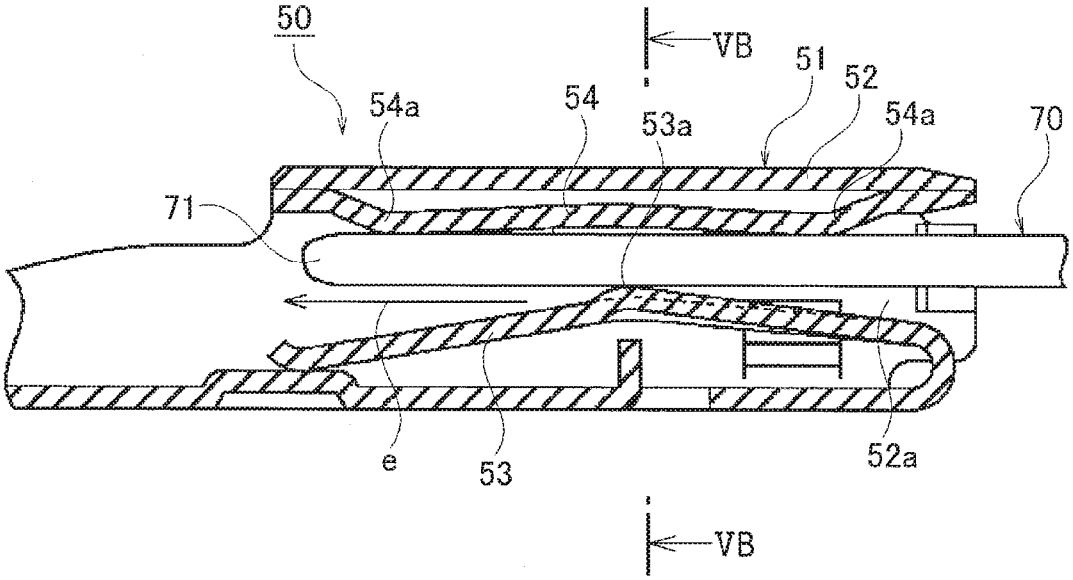
FIG. 5A PRIOR ART
FIG. 5A, which shows a conventional example, is a cross-sectional view perpendicular to a tab insertion direction of a female terminal with which a male terminal is engaged.
Figure 5B:
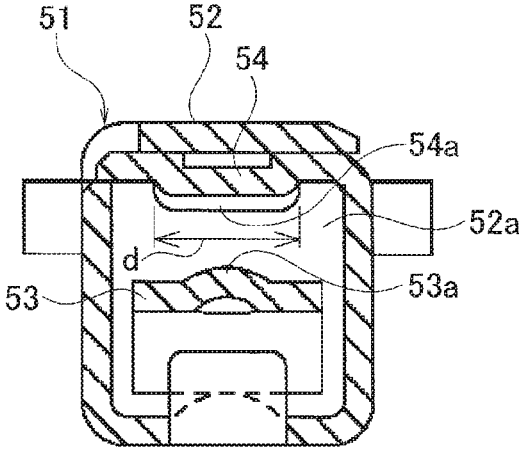
FIG. 5B PRIOR ART
FIG. 5B, which shows a conventional example, is a cross-sectional view taken along the line VB-VB, i.e., a side cross-sectional view, of FIG. 5A.
Figure 5C:
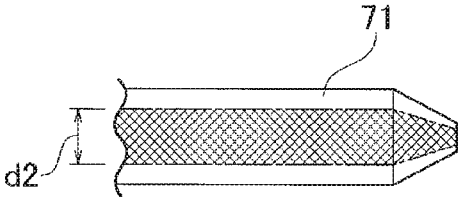
FIG. 5C PRIOR ART
FIG. 5C, which shows a conventional example, is a plan view of a substantial part in which a sliding portion (area) of a tab is indicated by cross-hatching.

Engagement of the terminals will now be described. When the tab 31 of the male terminal 30 is inserted into the terminal insertion chamber 7 of the female terminal 1, the tab 31 makes contact with the leaf spring portion 8. Then, as shown in FIG. 4, the tab 31 presses the leaf spring portion 8 and the leaf spring portion 8 is deflected. The tab 31, which is subject to an elastic restoring force from the leaf spring portion 8, is pressed toward the projecting portion 11 of the tab clamping projection wall 10. The deflection of the leaf spring portion 8 allows the tab 31 to be further inserted into the terminal insertion chamber 7, the tab 31 slides on the projecting portion 11 of the tab clamping projection wall 10, and the terminals are engaged as shown in FIGS. 2A and 2B. The tab 31 makes contact at three points including the spring side projection 8*a* of the leaf spring portion 8 and the pair of projections 11*a*, with an elastic restoring force of the leaf spring portion 8 as a contact load. Thus, the female terminal 1 is electrically connected to the male terminal 30 at the three points.

Figure 2C:
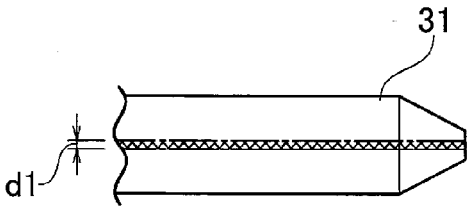
FIG. 2C, which illustrates the embodiment of the present invention, is a plan view of a substantial part in which a sliding portion (area) of a tab is indicated by cross-hatching.

The female terminal 1 causes the tab 31 to make contact at three points including the spring side projection 8*a* of the leaf spring portion 8 and the pair of projections 11*a* when the terminals are engaged so that the female terminal 1 provides a stable and vibration-resistant contact compared to the case where the contact is made at two points. In particular, oscillation (swinging motion) of the tab 31 about the spring side projection 8*a* of the leaf spring portion 8 is restricted by the two projections 11*a* of the tab clamping projection wall 10, and thus such oscillation can be effectively reduced. Furthermore, the tab 31 is inserted while sliding on the projecting portion 11 protruding further than the tab clamping projection wall 10 upon insertion of the tab 31 of the male terminal 30 so that a sliding width d1 is much smaller than a width of the tab clamping projection wall 10 as illustrated in FIG. 2C, thereby reducing a terminal insertion force. As seen from the above, the female terminal 1 provides a stable and vibration-resistant contact, and moreover, the terminal insertion force is small. The sliding width d1 of the tab 31 can be adjusted, for example, based on the width of the projecting portion 11.

The tab clamping projection wall 10 is formed in a curved shape that is spaced from the tab 31 at the position of the spring side projection 8*a* and is close to the tab 31 at the front and rear positions in the tab insertion direction e relative to the position of the spring side projection 8*a*, and the projecting portion 11 is formed in a curved shape conforming to the tab clamping projection wall 10. The projecting portion 11 is therefore formed in a curved shape, with the amount of projection of the projecting portion 11 being the same at any position in the tab insertion direction e. As a modification, it may be configured such that the tab clamping projection wall 10 is formed straight, i.e., without curving relative to the tab insertion direction e, and the projecting portion 11 is formed in a curved shape by varying the amount of projection of the projecting portion 11 along the tab insertion direction e.

The projecting portion 11 is an arc-shaped projection in cross-section perpendicular to the tab insertion direction e. As such, the sliding width d1 of the tab 31 can be reduced and the tab 31 can be smoothly inserted, with a corner of the projecting portion 11 being prevented from impinging on the tab 31, even if the tab 31 is inserted into the terminal insertion chamber 7 at an angle.

What is claimed is:

1. A terminal comprising:

a terminal connection part into which a tab of a mating terminal is inserted;

a leaf spring portion that is arranged in the terminal connection part and is deflected by being pressed by the tab to be inserted; and a tab clamping projection wall that extends in a tab insertion direction at a position spaced apart from the leaf spring portion and clamps the inserted tab between itself and the leaf spring portion, wherein the leaf spring portion is provided with a spring side projection protruding toward the tab clamping projection wall, the tab clamping projection wall is provided with a projecting portion whose dimension perpendicular to the tab insertion direction is smaller than that of the tab clamping projection wall and which protrudes toward the leaf spring portion and extends in the tab insertion direction, and the projecting portion is formed in a curved shape that is spaced from the tab at a position of the spring side projection and is close to the tab at front and rear positions in the tab insertion direction relative to the position of the spring side projection.

2. The terminal according to claim 1, wherein the tab clamping projection wall is formed in a curved shape that is spaced from the tab at a position of the spring side projection and is close to the tab at front and rear positions in the tab insertion direction relative to the position of the spring side projection, and the projecting portion is formed in a curved shape conforming to the tab clamping projection wall.

3. The terminal according to claim 2, wherein the projecting portion has a same amount of projection at any position in the tab insertion direction.

4. The terminal according to claim 2, wherein the curved shape of the projecting portion is provided with a pair of projections at a front position and a rear position in the tab insertion direction relative to a position of the spring side projection.

5. The terminal according to claim 2, wherein a width dimension of the projecting portion perpendicular to the tab insertion direction is smaller than that of the tab clamping projection wall.

6. The terminal according to claim 1, wherein the projecting portion is an arc-shaped projection in cross-section perpendicular to the tab insertion direction.

7. The terminal according to claim 1, wherein the terminal connection part includes a bottom wall, a pair of side walls, and a top wall, the bottom wall, the pair of side walls, and the top wall constitute a square tubular shape, an inside of the square tubular shape is provided with a terminal insertion chamber into which the tab of the terminal is inserted, and the terminal insertion chamber receives the leaf spring portion.

8. The terminal according to claim 7, wherein the bottom wall comprises an auxiliary spring portion having a tip portion, the tip portion of the auxiliary spring portion is arranged in a deflection region on the distal side of the leaf spring portion such that a deflection of the leaf spring portion causes the auxiliary spring portion to deflect, thereby increasing a spring force of the leaf spring portion.

9. The terminal according to claim 7, wherein the top wall comprises two plates superimposed on each other, a lower plate of the two plates of the top wall is provided with the tab clamping projection wall protruding into the terminal insertion chamber, the tab clamping projection wall is located at a position spaced apart from the leaf spring portion.

10. The terminal according to claim 7, wherein the tab of the mating terminal is inserted into the terminal insertion chamber of the terminal such that the tab makes contact with the leaf spring portion and presses the leaf spring portion such that the leaf spring portion is deflected, the tab is pressed toward the projecting portion of the tab clamping projection wall by an elastic restoring force from the leaf spring portion, the deflection of the leaf spring portion allows the tab to be further inserted into the terminal insertion chamber such that the tab makes contact at three points including the spring side projection of the leaf spring portion and a pair of projections of the curved shape of the projecting portion.

* * * * *